US006165961A

United States Patent [19]

Schmid et al.

[11] Patent Number: 6,165,961

[45] Date of Patent: Dec. 26, 2000

[54] WATER-FREE SURFACE-ACTIVE AGENTS

[75] Inventors: Karl-Heinz Schmid, Mettmann; Ditmar Kischkel, Monheim; Thomas Krohnen, Duesseldorf; Andreas Syldath, Monheim, all of Germany

[73] Assignee: Henkel Kommanditgesellschaft auf Aktien, Duesseldorf, Germany

[21] Appl. No.: 09/308,539

[22] PCT Filed: Nov. 11, 1997

[86] PCT No.: PCT/EP97/06273

§ 371 Date: May 20, 1999

§ 102(e) Date: May 20, 1999

[87] PCT Pub. No.: WO98/22561

PCT Pub. Date: May 28, 1998

[30] Foreign Application Priority Data

Nov. 20, 1996 [DE] Germany ..... 196 48 014

[51] Int. Cl.[7] ..... C11D 1/37

[52] U.S. Cl. ..... 510/352; 510/443; 510/498

[58] Field of Search ..... 510/443, 444, 510/352, 498

[56] References Cited

U.S. PATENT DOCUMENTS 3,703,772 11/1972 McHugh et al. ..... 34/9
3,870,649 3/1975 Langstroth ..... 252/301.3 W
4,715,979 12/1987 Moore et al. ..... 252/91
5,066,425 11/1991 Ofosu-Asante et al. .

FOREIGN PATENT DOCUMENTS 0 560 001 A1 9/1993 European Pat. Off. .
41 24 701 1/1993 Germany .

*Primary Examiner*—John R. Hardee
*Attorney, Agent, or Firm*—John E. Drach; Thomas F. Roland; Henry E. Millson, Jr.

[57] ABSTRACT

A water-free surfactant composition containing: (a) a fatty alcohol sulfate corresponding to the formula $R^1O—SO_3X$, where $R^1$ is a linear alkyl chain, and X is an alkali metal, alkaline earth metal, ammonium, alkyl ammonium, alkanolammonium or glucammonium; and (b) an alkyl benzenesulfonate corresponding to the formula $R^2—Ph—SO_3X$ where $R^2$ is an alkyl chain containing 10 to 14 carbon atoms, Ph is a phenyl group and X is alkali metal, alkaline earth metal, ammonium, alkyl ammonium, alkanolammonium or glucammonium. The fatty alcohol sulfate and alkyl benzenesulfonate are present in the surfactant composition in a weight ratio of 50:50 to 90:10. The water-free surfactant composition provides a reduced potential for irritation, good flow behavior and solubility in cold water. The surfactant composition is useful in laundry detergents, dishwashing detergents and cleaners.

8 Claims, No Drawings

WATER-FREE SURFACE-ACTIVE AGENTS

BACKGROUND OF THE INVENTION

1. Field of the Invention

This invention relates to water-free surfactant mixtures with a reduced potential for irritation containing selected fatty alcohol sulfates and alkyl benzenesulfonates in selected mixing ratios and to their use for the production of surface-active compositions.

2. Discussion of Related Art

By virtue of their favorable applicational properties and their excellent ecological compatibility, fatty alcohol sulfates represent anionic surfactants which are acquiring increasing significance for the production of laundry detergents, dishwashing detergents and cleaning compositions.

Highly concentrated, aqueous or water-free solid formulations of anionic surfactants are of course desirable for storage and transportation purposes. Unfortunately, such formulations are attended by the disadvantage that, in contrast to the products diluted to the in-use concentration, they have a highly irritating effect on the skin and mucous membrane which means that more stringent safety-in-use requirements have to be satisfied for marketing. Another disadvantage is that known compositions do not possess sufficient flowability or solubility, especially in cold water.

DE-C2 2857292 describes detergent compositions containing alkyl sulfates and alkyl benzenesulfonates in which selected polymers are present as soil repellents. According to International patent application WO 95/02036 (Unilever), free-flowing surfactant granules are obtained by mixing 33 to 55% by weight of a liquid acidic anionic surfactant mixture (for example alkyl benzenesulfonic acid or alkyl sulfuric acid semiester) with 20 to 50% by weight of zeolite and 2 to 25% by weight of alkali metal carbonate.

Accordingly, the complex problem addressed by the present invention was to provide new water-free surfactant mixtures which would be distinguished by a significantly reduced potential for irritation, improved flow behavior and improved solubility.

DESCRIPTION OF THE INVENTION

The present invention relates to water-free surfactant mixtures containing (a) fatty alcohol sulfates corresponding to formula (I):

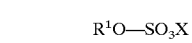

$$R^1O—SO_3X \quad (I)$$

in which $R^1$ is a linear alkyl chain containing 16 and/or 18 carbon atoms and X is an alkali metal and/or alkaline earth metal, ammonium, alkyl ammonium, alkanolammonium or glucammonium, and (b) alkyl benzenesulfonates corresponding to formula (II):

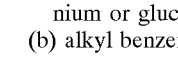

$$R^2—Ph—SO_3X \quad (II)$$

in which $R^2$ is an alkyl chain containing 10 to 14 carbon atoms, Ph is a phenyl group and X is again an alkali metal and/or alkaline earth metal, ammonium, alkyl ammonium, alkanolammonium or glucammonium, in a ratio by weight of 50:50 to 90:10, preferably 60:40 to 85:15 and, more preferably, 75:25 to 80:20.

It has surprisingly been found that the compositions according to the invention combine a synergistic reduction in their irritation potential with very favorable applicational properties, more especially improved flow behavior and solubility in cold water.

Fatty Alcohol Sulfates

Fatty alcohol sulfates which form component (a) are known anionic surfactants and are normally obtained by reacting fatty alcohols with sulfating agents, such as sulfuric acid, oleum, chlorosulfonic acid and, in particular, gaseous sulfur trioxide. The resulting sulfuric acid semiesters are then neutralized with suitable bases. In the context of the invention, fatty alcohol sulfates corresponding to formula (I) are sulfation products of fatty alcohols containing 16 to 18 carbon atoms. Typical examples are the sulfates of cetyl alcohol and stearyl alcohol. Technical fatty alcohol cuts, for example tallow alcohol, which may contain small amounts of even shorter or longer chain homologs are preferably used. Technical fatty alcohol cuts may also be mixed in such a way that an alcohol mixture in which the C chain distribution is mainly between 16 and 18 carbon atoms is obtained. This is of advantage, for example, when the percentage content of vegetable alcohols in the mixture is intended to be as high as possible.

Alkyl Benzenesulfonates

Alkyl benzenesulfonates which form component (b) are also known anionic surfactants which are normally prepared by nuclear sulfonation of linear alkyl benzenes and suitable neutralization of the resulting products. Typical examples are sulfonation products of decyl benzene, dodecyl benzene and tetradecyl benzene and technical mixtures thereof which are used in the form of their sodium or potassium salts.

Mixing of the Components

The mixing of the components is not critical. In the most simple case, the aqueous pastes obtained after neutralization of the crude sulfonation products are mixed, for example in a Schugi mixer, and at the same time converted into a water-free particulate product. Similarly, dry-neutralized or spray-dried or superheated steam-dried powders of the two components may also be mixed. It is also possible to prepare a corresponding mixture in situ by co-sulfation of fatty alcohols and alkyl benzenes, neutralization and optionally drying. Finally, the acidic sulfation products may also be neutralized together and then further processed. In a preferred embodiment of the invention, the starting material is a conventionally produced tower powder which may also contain one of the two anionic surfactant components in addition to the usual detergent ingredients. The powder is initially introduced into a mixer and, after the continuous addition of at least one of the two anionic surfactant components, preferably in the form of an aqueous paste, the whole is mixed, dried and optionally further mechanically compacted. A dry detergent powder, granules or an extrudate with excellent detersive properties, a high dissolving rate and a reduced irritation potential is obtained. In another preferred embodiment of the present invention, water-containing pastes with an active substance content of 10 to 60 and preferably 30 to 50% by weight can be dried and, at the same time, granulated in a so-called flash dryer of the type obtainable from VRV, lt.

The surfactant mixtures according to the invention are distinguished not only by very favorable detersive properties, but also and above all by a synergistically reduced potential for irritation, i.e. by improved compatibility with the skin and ocular mucous membrane. Accordingly, they are suitable for the production of laundry detergents, dishwashing detergents and cleaning compositions, especially solid laundry detergents, in which they may be present in quantities of 1 to 90% by weight and preferably 10 to 50% by weight, based on the detergent.

Laundry Detergents, Dishwashing Detergents and Cleaners

Typical examples of laundry detergents, dishwashing detergents and cleaners which may contain the water-free surfactant mixtures according to the invention are liquid to paste-like fabric softeners, manual dishwashing detergents, machine dishwashing detergents, rinse aids and heavy duty, domestic and sanitary cleaners and also powder-form or granular heavy-duty detergents. The detergents/cleaners may contain other typical ingredients such as, for example, builders, enzymes, enzyme stabilizers, bleaching agents, optical brighteners, thickeners, soil repellents, foam inhibitors, solubilizers, inorganic salts and dyes and fragrances.

Suitable builders are zeolites, layer silicates, phosphates and ethylenediamine tetraacetic acid, nitrilotriacetic acid, citric acid and inorganic phosphonic acids.

Among the compounds used as peroxy bleaching agents, sodium perborate tetrahydrate and sodium perborate monohydrate are particularly important. Other bleaching agents are, for example, peroxycarbonate, citrate perhydrates and $H_2O_2$-yielding peracidic salts of peracids, such as perbenzoates, peroxyphthalates or diperoxydodecanedioic acid. They are normally used in quantities of 8 to 25% by weight. It is preferred to use sodium perborate monohydrate in quantities of 10 to 20% by weight and, more particularly, 10 to 15% by weight. By virtue of its ability to bind free water to form the tetrahydrate, it contributes towards increasing the stability of the composition.

Suitable thickeners are, for example, hydrogenated castor oil, salts of long-chain fatty acids which are preferably used in quantities of 0 to 5% by weight and, more particularly, in quantities of 0.5 to 2% by weight, for example sodium, potassium, aluminium, magnesium and titanium stearates or the sodium and/or potassium salts of behenic acid, and other polymeric compounds. These preferably include polyvinyl pyrrolidone, urethanes and the salts of polymeric polycarboxylates, for example homopolymeric or copolymeric polyacrylates, polymethacrylates and, in particular, copolymers of acrylic acid with maleic acid, preferably those of 50 to 10% of maleic acid. The relative molecular weight of the homopolymers is generally between 1,000 and 100,000 while the relative molecular weight of the copolymers is between 2,000 and 200,000 and preferably between 50,000 and 120,000, based on the free acid. Water-soluble polyacrylates which have been crosslinked, for example, with about 1% of a polyallyl ether of sucrose and which have a relative molecular weight above 1,000,000 are also particularly suitable. Examples of such polyacrylates are the polymers obtainable under the name of Carbopol® 940 and 941. The crosslinked polyacrylates are preferably used in quantities of not more than 1% by weight and, more preferably, in quantities of 0.2 to 0.7% by weight.

Suitable enzymes are those from the class of proteases, lipase, amylases, cellulases and mixtures thereof. Enzymes obtained from bacterial strains or fungi, such as *Bacillus subtilis, Bacillus licheniformis* and *Streptomyces griseus,* are particularly suitable. Proteases of the subtilisin type and, more particularly, proteases obtained from *Bacillus lentus* are preferably used. They may be present in quantities of about 0.2 to 2% by weight. The enzymes may be adsorbed onto supports or encapsulated in shell-forming substances to protect them against premature decomposition.

In addition to monofunctional and polyfunctional alcohols and phosphonates, the compositions may contain other enzyme stabilizers. For example, 0.5 to 1% by weight of sodium formate may be used. Proteases which have been stabilized with soluble calcium salts and which have a calcium content of, preferably, about 1.2% by weight, based on the enzyme, may also be used. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

Where the detergents are used in washing machines, it can be of advantage to add conventional foam inhibitors to them. Suitable foam inhibitors contain, for example, known organopolysiloxanes, paraffins or waxes.

EXAMPLES

The flowability of the products was subjectively determined by the clumping test; (+) signifies good flowability, (–) limited flowability and (—) a marked tendency to clump. To determine solubility, 10 g of the water-free formulations were dissolved or dispersed in 100 ml of water (30° C., 16° d). After 120 s, the solutions or dispersions were filtered and the residue was dried and weighed out. The residue is expressed in %-rel. based on the quantity used. The irritation potential was determined by OECD Method No. 404 and EEC Directive 84/449 EEC, Pt. B. 4. The total irritation scores shown were calculated from the irritation scores obtained after 24, 48 and 72 hours. The total irritation score determined in comparison test C1 for a 100% $C_{16/18}$ tallow alcohol sulfate sodium salt was put at 100% and the total irritation scores obtained in the other tests were related to that score. The results are set out in Table 1. Formulations 1 to 4 correspond to the invention while formulations C1 to C5 are intended for comparison.

TABLE 1

| | Applicational properties | | | | | | | | |
|---|---|---|---|---|---|---|---|---|---|
| Composition | 1 | 2 | 3 | 4 | 5 | C1 | C2 | C3 | C4 |
| $C_{16/18}$ tallow alcohol sulfate, Na salt | 60 | 75 | 80 | 85 | 90 | 100 | 40 | 20 | 0 |
| Dodecyl benzenesulfonate, Na salt | 40 | 25 | 20 | 15 | 10 | 0 | 60 | 80 | 100 |
| Flow behavior | + | + | + | + | + | – | – | – | – |
| Solubility-residue [%-rel] | 43 | 36 | 28 | 31 | 37 | 45 | 57 | 61 | 65 |
| Total irritation score [%-rel] | 98 | 100 | 98 | 95 | 100 | 100 | 110 | 120 | 130 |

What is claimed is:

1. A dry surfactant composition comprising:

(a) a fatty alcohol sulfate corresponding to the formula $$R^1O—SO_3X \quad (I)$$

wherein $R^1$ is a linear $C_{16-18}$ alkyl chain, and X is an alkali metal, alkaline earth metal, ammonium, alkyl ammonium, alkanolammonium or glucammonium; and (b) an alkyl benzenesulfonate corresponding to the formula $$R^2—Ph—SO_3X \quad (II)$$

wherein $R^2$ is an alkyl chain containing 10 to 14 carbon atoms, Ph is a phenyl group and X is an alkali metal, alkaline earth metal, ammonium, alkyl ammonium, alkanolammonium or glucammonium, wherein the rate ratio of (a) to (b) is from 60:40 to 85:15.

2. The surfactant composition of claim 1 wherein the weight ratio of (a) to (b) is from 75:25 to 80:20.

3. The surfactant composition of claim 1 wherein the fatty alcohol sulfate is the sulfation product of tallow alcohol.

4. A laundry detergent, dishwashing detergent, or cleaner comprising from 1 to 90 percent by weight of the surfactant composition of claim 1.

5. The laundry detergent, dishwashing detergent, or cleaner of claim 4 wherein said percent by weight is from 10 to 50 percent.

6. The composition of claim 1 wherein in component (b), $R^2$ is decyl, dodecyl, or tetradecyl.

7. The composition of claim 1 wherein in component (b), X is sodium or potassium.

8. The composition of claim 6 wherein in component (b), X is sodium or potassium.

* * * * *